US005228581A

United States Patent [19]

Palladino et al.

[11] Patent Number: 5,228,581

[45] Date of Patent: Jul. 20, 1993

[54] SOLID STATE SHELF MEANS FOR TRANSFORMING AN OPEN WIRE SHELF INTO A SOLID SUPPORT WITHIN A REFRIGERATED DISPLAY CASE

[75] Inventors: Michael J. Palladino; Robert M. Foy, both of Trenton; Glenn Morris, Hamilton Square, all of N.J.

[73] Assignee: Hill Refrigeration Division, Falcon Manufacturing Inc., Trenton, N.J.

[21] Appl. No.: 758,066

[22] Filed: Sep. 12, 1991

[51] Int. Cl.[5] ..... A47F 5/08

[52] U.S. Cl. ..... 211/153; 211/135; 108/90

[58] Field of Search ..... 211/153, 134, 135; 108/90, 11, 12, 13

[56] References Cited

U.S. PATENT DOCUMENTS

| | | | |
|---|---|---|---|
| 158,718 | 1/1875 | Landis | 108/12 X |
| 584,082 | 6/1897 | Nessle . | |
| 683,481 | 10/1901 | McLane | 211/153 |
| 1,173,143 | 2/1916 | Covington et al. . | |
| 1,576,784 | 3/1926 | Planett . | |
| 1,713,620 | 5/1929 | Pauk . | |
| 1,716,366 | 6/1929 | Bond . | |
| 1,723,460 | 8/1929 | Beare . | |
| 2,006,046 | 6/1935 | Huckestein . | |
| 2,049,594 | 8/1936 | Stultz . | |
| 2,050,063 | 8/1936 | Millott . | |
| 2,074,785 | 3/1937 | Gentz . | |
| 2,095,810 | 10/1937 | Goulooze . | |
| 2,169,904 | 8/1939 | Schweller . | |
| 2,241,854 | 5/1941 | Hall et al. . | |
| 2,403,164 | 7/1946 | Ahrens et al. | 211/153 |
| 2,490,413 | 12/1949 | Burtis . | |
| 2,505,322 | 4/1950 | Drake . | |
| 2,600,755 | 6/1952 | Greensfelder . | |
| 2,684,884 | 7/1954 | Devery . | |
| 2,689,778 | 9/1954 | Chambers et al. . | |
| 2,717,189 | 9/1955 | Teague et al. . | |
| 2,741,525 | 4/1956 | Sywert . | |
| 2,744,807 | 5/1956 | Bently . | |
| 2,746,609 | 5/1956 | Welsh . | |
| 2,811,407 | 10/1957 | Moore et al. . | |
| 2,822,672 | 2/1958 | Dickson et al. . | |
| 2,840,439 | 6/1958 | Sharpe . | |
| 2,868,607 | 1/1959 | Squire . | |
| 2,876,910 | 3/1959 | Morton, Jr. | 211/153 |
| 2,952,992 | 9/1960 | Voorhies . | |
| 2,962,874 | 12/1960 | Fitzgerald . | |
| 3,167,187 | 1/1965 | Sarkisian | 211/153 |
| 3,186,364 | 6/1965 | Costantini et al. . | |
| 3,220,364 | 11/1965 | Sandin . | |
| 3,320,011 | 5/1967 | Sachnoff et al. . | |
| 3,575,484 | 4/1971 | Kesling . | |
| 3,625,371 | 12/1971 | Dill | 108/90 X |
| 3,635,355 | 1/1972 | Kronenberger . | |
| 3,638,801 | 2/1972 | Larson | 211/162 X |
| 3,690,744 | 9/1972 | Squire . | |
| 3,797,903 | 3/1974 | Travlsen . | |
| 3,825,050 | 7/1974 | Glover | 108/90 X |
| 3,832,957 | 9/1974 | Mendenhall | 211/153 |
| 3,865,448 | 2/1975 | Winterheimer . | |
| 4,318,487 | 3/1982 | McCarthy . | |
| 4,416,120 | 11/1983 | Yono et al. . | |
| 4,606,170 | 8/1986 | Mendenhall | 211/135 X |
| 4,679,818 | 7/1987 | Kakavas | 108/90 X |
| 4,716,840 | 1/1988 | Tringali et al. | 108/90 X |
| 4,717,104 | 1/1988 | Lee . | |
| 4,725,107 | 2/1988 | Appleton . | |
| 4,729,613 | 3/1988 | Tromble et al. | 211/153 X |
| 4,744,611 | 5/1988 | Tamura et al. . | |
| 4,760,930 | 8/1988 | Fox | 211/153 |
| 4,777,888 | 10/1988 | Waterman et al. . | |
| 4,781,349 | 11/1988 | Remmers . | |
| 4,934,541 | 6/1990 | Bussan et al. | 211/153 |
| 4,960,308 | 10/1990 | Donaghy | 211/153 X |
| 4,974,502 | 12/1990 | Murdock | 211/153 X |

*Primary Examiner*—David A. Scherbel
*Assistant Examiner*—Korie H. Chan
*Attorney, Agent, or Firm*—Sperry, Zoda & Kane

[57] ABSTRACT

A device for forming a solid support surface adjacent an open wire shelf having a front support member, a rear support member and a plurality of intermediate wire members which have longitudinal openings therebetween wherein the solid support surface is flexibly resilient to be snapped in place between a slot defined in the ticket molding secured along the front support member of the open wire shelf and the rear support member thereof. The cover plate of the solid shelf device preferably is of a plastic or spring steel material to facilitate placement thereof between a slot defined by the ticket molding and the rear support member.

29 Claims, 3 Drawing Sheets

SOLID STATE SHELF MEANS FOR TRANSFORMING AN OPEN WIRE SHELF INTO A SOLID SUPPORT WITHIN A REFRIGERATED DISPLAY CASE

BACKGROUND OF THE INVENTION

1. Field Of The Invention

The present invention deals with the field of devices for retaining articles in position displayed in any of a variety of manners such as on display within a refrigerated display case. Such refrigerated display cases commonly utilize open shelving formed by a plurality of wire members extending longitudinally to define longitudinal slots therebetween to facilitate the flow of refrigerated air therebetween. In certain configurations it is more advantageous to provide a solid support surface on the shelf for supporting of certain particularly shaped articles or for controlling the flow of air therealong. The present invention provides a means for providing a conversion between a solid support shelf and an open support shelf as desired. For the purposes of this invention, the term "solid shelf" means any shelf made of more solid material other than a shelf made from metallic wire members. Such a solid shelf can define a plurality of apertures therein but the apertures will be smaller in nature than the apertures defined between wires which form a wire shelf.

2. Description Of The Prior Art

There are a variety of different types of examples of designs utilized for the same or similar purposes to the present invention such as those shown in U.S. Pat. No. 584,082 patented Jun. 8, 1897 to Nessle for a Shelf For Refrigerators Or Ice Boes; U.S. Pat. No. 1,173,143 patented Feb. 22, 1916 to Covington et al on a Support; U.S. Pat. No. 1,576,784 patented Mar. 16, 1926 to Planett on Antproof Shelving; U.S. Pat. No. 1,713,620 patented May 21, 1929 to Pauk on a Refrigerator Display Case; U.S. Pat. No. 1,716,366 patented Jun. 11, 1929 to Bond on a Baffle Tray For Refrigerated Display Counters; U.S. Pat. No. 1,723,460 patented Aug. 6, 1929 to Beare on Refrigeration; U.S. Pat. No. 2,006,046 patented Jun. 25, 1935 to Huckestein on a Shutter Type Partition For Refrigerators; U.S. Pat. No. 2,049,594 patented Aug. 4, 1936 to Stultz on a Display Case; U.S. Pat. No. 2,050,063 patented Aug. 4, 1936 to Millott on a Refrigerated Store Wihdow; U.S. Pat. No. 2,074,785 patented Mar. 23, 1937 to Gentz on a Refrigerator Cabinet Door Rack; U.S. Pat. No. 2,095,810 patented Oct. 12, 1937 to Goulooze on Refrigerating Apparatus; U.S. Pat. No. 2,169,904 patented Aug. 15, 1939 to Schweller on a Thermometer Bracket; U.S. Pat. No. 2,241,854 patented May 13, 1941 to Hall et al on an Air Conditioned Display Compartment; U.S. Pat. No. 2,490,413 patented Dec. 6, 1949 to Burtis on a Self-Service Refrigerated Display Case; U.S. Pat. No. 2,505,322 patented Apr. 25, 1950 to Drake on a Refrigerator Cabinet; U.S. Pat. No. 2,600,755 patented Jun. 17, 1952 to Greensfelder on a Cover Rack; U.S. Pat. No. 2,689,778 patented Sep. 21, 1954 to Chambers et al a Refrigerator Shelf Mounting Structure; U.S. Pat. No. 2,717,189 patented Sep. 6, 1955 to Teague et al on Refrigerator Shelves; U.S. Pat. No. 2,741,525 patented Apr. 10, 1956 to Sywert on a Stop For Sliding Shelf; U.S. Pat. No. 2,744,807 patented May 8, 1956 to Bently on an Adjustable Mezzanine Shelf For Refrigerated Display Cases; U.S. Pat. No. 2,746,609 patented May 22, 1956 to Welsh on a Wire Shelf For Closets And The Like; U.S. Pat. No. 2,811,407 patented Oct. 29, 1957 to Moore et al on a Cabinet Shelf; U.S. Pat. No. 2,822,672 patented Feb. 11, 1958 to Dickson et al on a Display Case With Adjustable Refrigerated Shelves; U.S. Pat. No. 2,840,439 patented Jun. 24, 1958 to Sharpe on a Refrigerator Shelf; U.S. Pat. No. 2,868,607 patented Jan. 13, 1959 to Squire on a Refrigerator Pullout Shelf; U.S. Pat. No. 2,952,992 patented Sep. 20, 1960 to Voorhies on a Refrigerated Shelf; U.S. Pat. No. 2,962,874 patented Dec. 6, 1960 to Fitzgerald on a Cooling Tray For Food Products And Beverages; U.S. Pat. No. 3,186,364 patented Jun. 1, 1965 to Costantini et al on a Shelf Retaining Means; U.S. Pat. No. 3,220,364 patented Nov. 30, 1965 to Sandin on a Vertically Adjustable Shelf; U.S. Pat. No. 3,320,011 patented May 16, 1967 to Sachnoff et al on a Liner For A Refrigerator Shelf; U.S. Pat. No. 3,575,484 patented Apr. 20, 1971 to Kesling on a Convertible Cantilevered Shelf; U.S. Pat. No. 3,635,355 patented Jan. 18, 1972 to Kronenberger on a Drawer Support For Wire Shelf; U.S. Pat. No. 3,690,744 patented Sep. 12, 1972 to Squire on an Adjustable Refrigerator Shelf; U.S. Pat. No. 3,797,903 patented Mar. 19, 1974 to Traulsen on a Refrigerator Including Shelf Mounting Apparatus; U.S. Pat. No. 3,865,448 patented Feb. 11, 1975 to Winterheimer on a Shelf Retainer; U.S. Pat. No. 4,318,487 patented Mar. 9, 1982 to McCarthy on an Adjustable End Bracket; U.S. Pat. No. 4,416,120 patented Nov. 22, 1983 to Yono et al on a Spray Assembly For Refrigerated Display Cases; U.S. Pat. No. 4,717,104 patented Jan. 5, 1988 to Lee on a Wall Bracket With Adjustable Mounting Face; U.S. Pat. No. 4,725,107 patented Feb. 16, 1988 to Appleton on a Refrigerator With Improved Access; U.S. Pat. No. 4,744,611 patented May 17, 1988 to Tamura et al on a Display Cabinet; U.S. Pat. No. 4,777,888 patented Oct. 18, 1988 to Waterman et al on Cantilever Wall-Mount Shelving and U.S. Pat. No. 4,781,349 patented Nov. 1, 1988 to Remmers on a Ventilated Shelf Reinforcing Element.

SUMMARY OF THE INVENTION

The present invention provides a solid shelf device adapted to form a solid support surface above an open wire shelf. The open wire shelf preferably includes a front support member and a rear support member with a plurality of intermediate wire members defining openings therebetween.

The solid shelf means includes a front molding securable with respect to the front support member of the open wire shelf in such a manner as to define a slot therein adjacent the open wire shelf preferably facing rearwardly therefrom in a horizontally extending direction thereover. A cover plate is also preferably included in the present invention which is flexibly resilient in material and is detachably secured with respect to the open wire shelf to extend generally horizontally thereover in abutment preferably with respect to the upper portions of the intermediate members of the open wire shelf in order to form the solid support surface thereon. The solid support surface can define a plurality of apertures or slots thereon. However, the surface is made from a flat stock material and is not formed of individual metallic wire elements as is the open wire shelf.

The cover plate preferably includes a main plate which is flexibly resilient and extends generally horizontally adjacent the intermediate wire members of the open wire shelf. Further included is a front edge means defined along one side of the open plate section and adapted to extend into the slot defined in the front molding to facilitate detachable securement of the main plate section with respect to the open wire shelf. The cover plate further includes a rear edge means defined along another edge of the main plate section spaced from the front edge means. This rear edge device preferably is flexibly resilient with respect to the front edge to facilitate detachable securement of the cover plate with respect to an open wire shelf.

Furthermore the cover plate includes a rear attachment means located adjacent the rear edge of the cover plate to facilitate attachment of the rear edge with respect to the rear support member as desired and aid in attachment of the main plate section with respect to the open wire shelf.

The front molding means preferably also includes a ticket display area for holding a price ticket therein to facilitate use of the shelving apparatus of the present invention within a refrigerated display case such as in a supermarket or the like. Furthermore the front molding may preferably include a product stop device extending upwardly therefrom generally perpendicular with respect to the surface of the open wire shelf to facilitate retainment of articles located upon the solid shelf means.

As shown in FIGS. 1 and 2 the manner of insertion can be the placement of the solid support shelf 12 into the slot defined by the front molding means 24 followed by snapping of the front molding means 24 onto the front support member 28 of the open wire shelf 10. Alternatively the front molding means 24 could be initially attached with respect to the front support member 18 of open wire shelf 10 followed by insertion of the solid support shelf 12 and particularly the front edge 32 thereof into the slot means 26 after bending of the solid support shelf 12 as shown best in FIG. 2.

The cover plate itself can be made of many materials including plastic such as polyvinylchloride or flexible steel. Additionally the front molding means may be of a plastic or metal material as desired for functional or decorative purposes.

The cover plate itself can also be formed as a completely solid flat piece of stock metal or other material. The cover plate can define a plurality of apertures therein as desired which may be necessary such as being dictated by the type of product being stored thereon or can be determined by the necessity for varying patterns of air flow within the refrigerated case. Regardless, for the purposes of the present invention, the term "solid support shelf" shall mean a piece of relatively stock metallic material which is flexibly resilient and which may define one or more plurality of apertures therein. This construction of the solid support shelf is to distinguish it from the open wire shelf which is formed from a plurality of wire members secured with respect to one another.

Preferably the rear attachment device comprises an L-shaped member adapted to extend under the rear support member of the open wire shelf to facilitate detachable securement of the cover plate with respect to the open wire shelf adjacent the rear edge thereof.

In the preferred configuration the depth of the cover plate from the front edge to the rear edge thereof should be greater than the distance between the slot defined in the rear portion of the front molding and the rear support member such that during placement of the cover plate it can resiliently flexed in an arcuate manner to decrease the depth thereof to allow placement of the front edge into the slot defined on the rear portion of the ticket molding while the rear attachment means is secured with respect to the rear support member. In this manner a reliable and efficient means is provided for quickly changing between the open slotted wire shelf supporting surface and a solid supporting surface. In this manner the strength of the wire shelf is provided while at the same time the complete support of a solid shelf is provided as desired.

It is an object of the present invention to provide a solid shelf means capable of transforming an open wire shelf into a solid support shelf as desired within a refrigerated display case wherein structural strength is maintained.

It is an object of the present invention to provide a solid shelf means capable of transforming an open wire shelf into a solid support shelf as desired within a refrigerated display case wherein conversion between a solid shelf and an open wire shelf is facilitated.

It is an object of the present invention to provide a solid shelf means capable of transforming an open wire shelf into a solid support shelf as desired within a refrigerated display case wherein initial capital outlay for shelving is minimized.

It is an object of the present invention to provide a solid shelf means capable of transforming an open wire shelf into a solid support shelf as desired within a refrigerated display case wherein maintenance for shelving within a refrigerated display case is minimized.

It is an object of the present invention to provide a solid shelf means capable of transforming an open wire shelf into a solid support shelf as desired within a refrigerated display case wherein down time of a display case due shelving difficulties is minimized.

It is an object of the present invention to provide a solid shelf means capable of transforming an open wire shelf into a solid support shelf as desired within a refrigerated display case wherein a single piece integral horizontally extending member can be flexibly biased in position between a rear support member and a slot defined in a ticket display molding to easily convert an open wire shelf into a solid shelf.

It is an object of the present invention to provide a solid shelf means capable of transforming an open wire shelf into a solid support shelf as desired within a refrigerated display case wherein cold air curtain flow patterns can be carefully and accurately controlled by way of choice of a solid or open shelf at various points within a refrigerated display case.

It is an object of the present invention to provide a solid shelf means capable of transforming an open wire shelf into a solid support shelf as desired within a refrigerated display case wherein the strength and inexpensiveness of a wire shelf is maintained while the option of having a solid support surface is made available.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
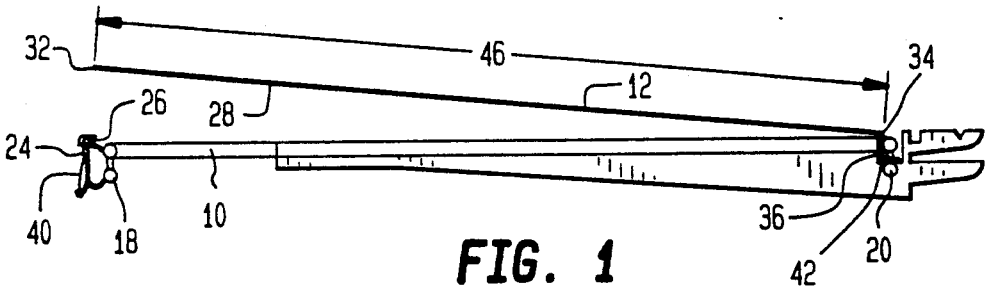
FIG. 1 is a side plan view of an embodiment of the solid shelf means of the present invention showing the cover plate in the partially inserted position.
Figure 2:
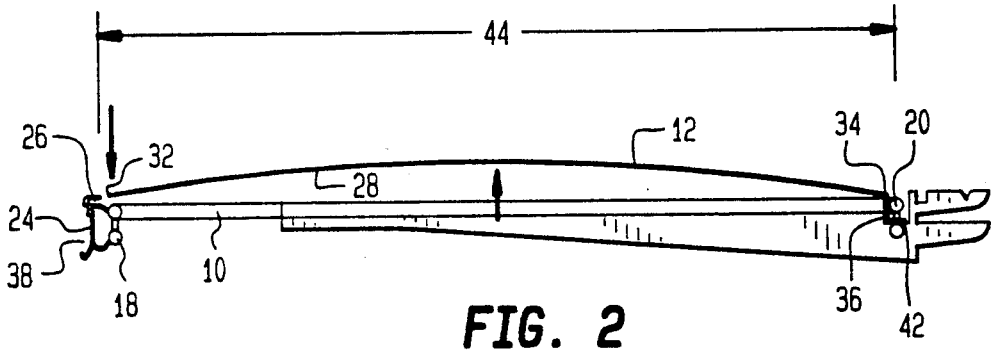
FIG. 2 is similar to the view shown in FIG. 1 with the cover plate in the process of being inserted into the slot adjacent the front edge thereof.
Figure 3:
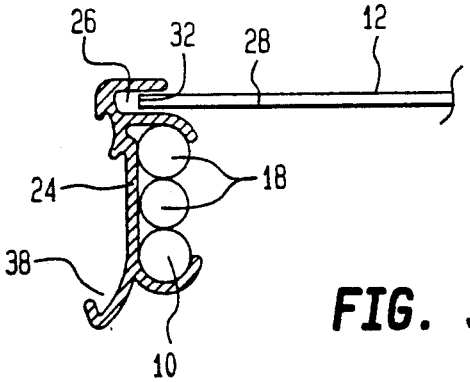
FIG. 3 is a cross-sectional view of the front portion of the solid shelf means of the present invention showing the cover plate in the fully inserted position.
Figure 5:
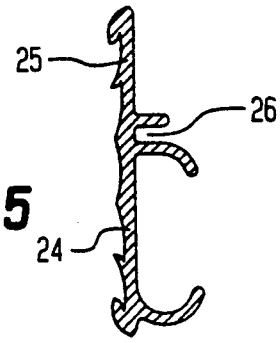
FIG. 5 is a side cross-sectional view of an alternative configuration for the front molding of the present invention including the product stop extending upwardly therefrom.

The present invention provides a solid support shelf 12 formed by a solid shelf means which includes an open wire shelf 10. Such open wire shelving 10 is commonly utilized in refrigerated display cases 14 and include a plurality of intermediate wire members 16 positioned in spaced relationship with respect to one another to define longitudinally extending openings 22.

The open wire shelf 10 includes a front support member 18 and a rear support member 20. The intermediate wire members 16 are positioned extending longitudinally parallel with respect to the front support member and the rear support member 20 and positioned therebetween to define the longitudinal openings 22.

A front molding means 24 is preferably detachably secured with respect to the front support member 18. The front molding means 24 primarily is adapted to include a ticket display means 38 in which a pricing ticket 40 may be positioned to indicate the price of items within the display case to customers.

The front molding means 24 preferably also includes a product stop means 25 extending upwardly therefrom to retain product upon the shelving 12 within the display case 14. The product stop means 25 basically comprises a protrusion extending upwardly to act as a stopping lip to retain product upon the shelf.

The front molding means 24 also defines in the rear portion thereof a slot means 26 extending rearwardly and outwardly therefrom to be parallel with respect to the upper surface of the open wire shelf 10.

Figure 4:
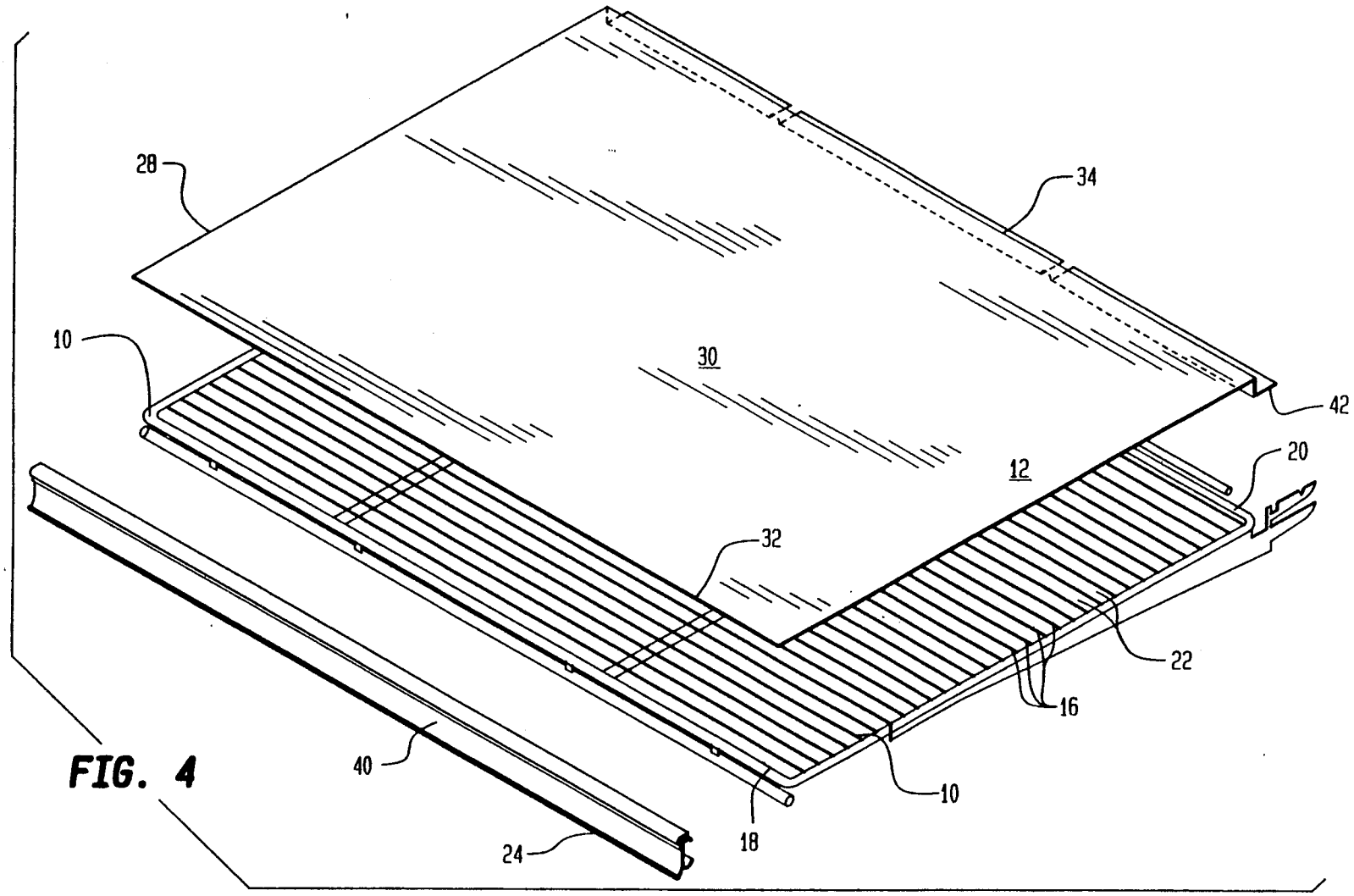
FIG. 4 shows an embodiment of the solid shelf means of the present invention in the unassembled position.

A cover plate means 28 is a primary element of the present invention and is adapted to extend horizontally over the open wire shelving 10 to provide a flat surface thereover and to close the longitudinally extending openings 22 defined therein. The flat surface of the cover plate means 28 can define one or more apertures, slots or other openings therein as desired. However, the flat surface thereof is designed to provide a smooth flat product support surface which is not possible from the open wire shelf 10. The cover plate means 28 preferably includes a main plate section 30 which is flexibly resilient and includes a front edge means 32 and a rear edge means 34. Rear edge means 34 is defined at the opposite end of the depth of the main plate section 30 as shown best in FIG. 4.

The rear edge means 34 includes a rear attachment means 36 either attached or integral with respect thereto. This rear attachment means 36 preferably comprises an L-shaped bracket 42 as shown best in FIGS. 1 and 4. L-shaped bracket 42 is adapted to be positioned underneath to be positioned underneath the rear support member 20 in such a manner as to be retained therein. When the cover plate means 28 is being positioned upon the open wire shelf 10, initially the rear attachment means 36 and the L-shaped bracket 42 thereof will be located below the rear support member 20 as shown in FIG. 1. The next step will be the arcing or bending of the flexibly resilient cover plate 28 and particularly the main plate section 30 thereof in such a manner as to allow the front edge means 32 to be positioned into the slot means 26 defined in the front molding 24. With this configuration the distance 44 between the slot means in the rear support member must be less than the distance 46 defined between the rear edge means and the front edge means. In this manner flexing of the main plate section 30 will allow locking of the main plate section 30 of the cover plate means 28 in position extending horizontally above the open wire shelf 10 in abutment with respect to the upper portions of the intermediate wire members 16 thereof.

With this configuration the strength of the open wire shelf 10 is maintained while the opportunity is afforded to the store owner or refrigeration engineer to choose between a flat support shelf 12 or an open wire shelf 10. The two different types of shelving provide different support means for various different types of products. Additionally and certainly equally importantly the two different types of shelving have varying impacts upon the flow of refrigerated air and particularly refrigerated air curtains located within the refrigerated display case 14.

The present invention provides a simple and inexpensive manner for shifting between a solid shelf and an open wire shelf as desired while still maintaining the strength of the open wire shelf and making available the possibility of transforming that shelf into a solid shelf inexpensively.

With the use of aluminum tag molding 48 the tag molding structure will include an L-shaped member 50. This member will be secured with respect to the aluminum molding 48 and will extend rearwardly therefrom to define the slot means 26 between the L-shaped member 50 and the front support member 18 of the open wire shelf 10.

Figure 7:
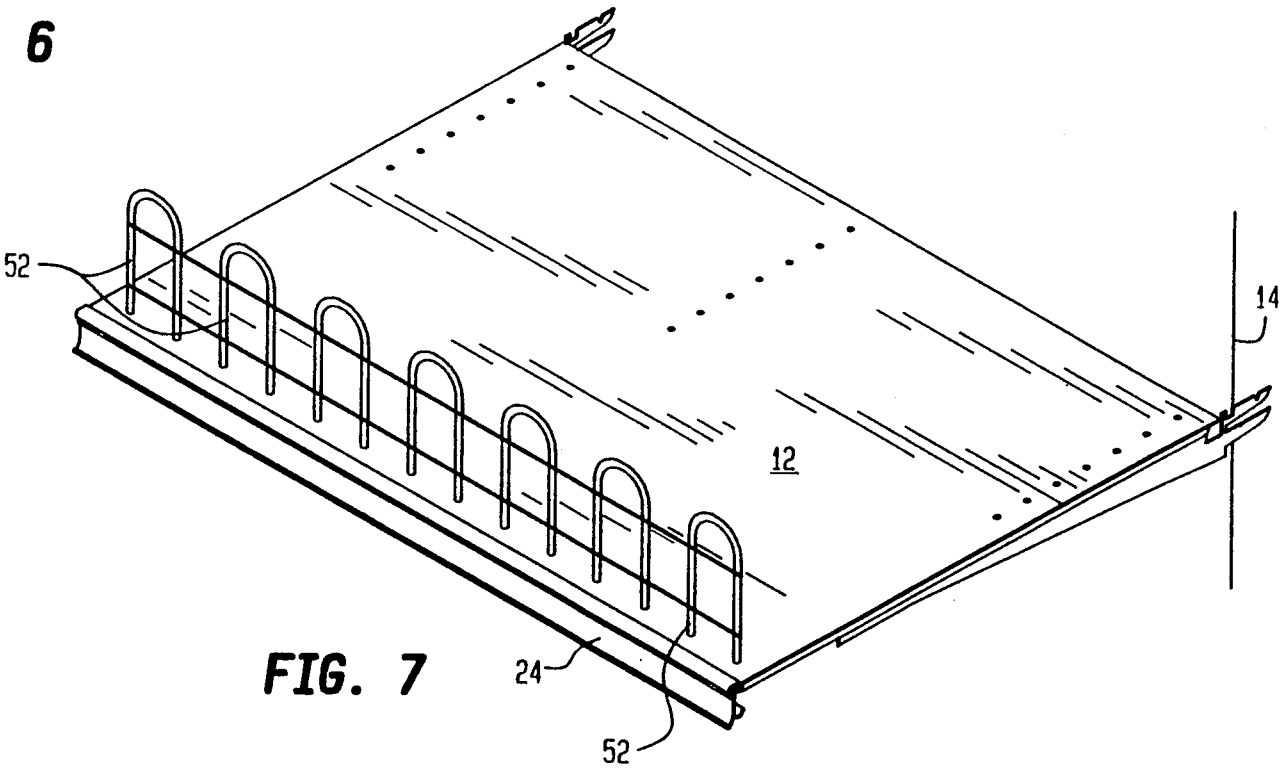
FIG. 7 shows an embodiment of the present invention utilizing supplementary product stock to facilitate control of product movement when positioned upon the solid support shelf.
Figure 6:
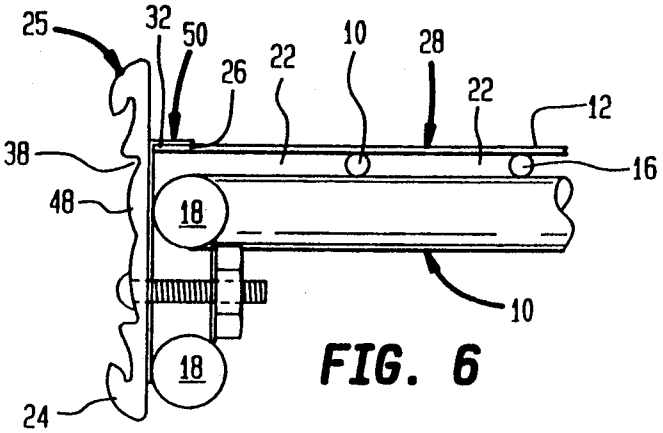
FIG. 6 is a side cross-sectional view of an alternative configuration of the front molding of the present invention showing the L-shaped member for use with front molding made of aluminum.

To further enhance retainment of the product positioned upon the open wire shelf 10 and the solid support shelf 12, it is preferable to include a supplementary product stop 52 as shown best in FIG. 7 including a plurality of upwardly extending members interconnected with respect to one another. The supplementary product stop 52 can be attached directed to the open wire shelf 10 or the solid support shelf 12 as shown in FIG. 7.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf comprising:

a) a front molding means securable with respect to the front support member of the open wire shelf and defining a slot means extending horizontally therein adjacent the open wire shelf;

b) a cover plate means being flexibly resilient and detachably securable with respect to the open wire shelf to extend generally horizontally thereover in abutment with respect to the intermediate wire members of the open wire shelf for forming a flat support surface thereon by extending horizontally over the longitudinal openings therebetween, said cover plate means including:

(1) a main plate section being flexibly resilient and extending generally horizontally adjacent and in abutment with the intermediate wire members of the open wire shelf and extending over the longitudinally extending openings defined therein;

(2) a front edge means along one edge of said main plate section and being adapted to extend into said slot means defined in said front molding means to facilitate detachably securement of said main plate section with respect to the open wire shelf;

(3) a rear edge means along another edge of said main plate section spaced from said front edge means, said cover plate means being flexibly resilient to selectively decrease the distance between said front edge means and said rear edge means thereof to facilitate detachable securement of said cover plate means with respect to the open wire shelf; and (4) a rear attachment means located adjacent said rear edge means of said cover plate means to facilitate attachment of said rear edge means with respect to the rear support member and attachment of said main plate section with respect to the open wire shelf.

2. A solid shelf means, in combination for use with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said front molding means includes a ticket display means for retaining a price ticket therein for display.

3. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said cover plate means is made of plastic.

4. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said cover plate means is made of polystyrene.

5. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said cover plate means is made of flexible steel.

6. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said front molding means is made of plastic.

7. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said front molding means is made of metal.

8. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said front molding means includes a product stop means extending therefrom to facilitate retainment of articles located upon said solid shelf means.

9. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 8 wherein said product stop means extends vertically upwardly with respect to said main plate section to facilitate retainment of articles located upon said solid shelf means.

10. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said rear attachment means comprises an L-shaped bracket adapted to extend under the rear support member of the open wire shelf to facilitate detachable securement of said cover plate means with respect to the open wire shelf.

11. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1, wherein said front molding means defines said slot means extending horizontally immediately adjacent the upper surface of the open wire shelf.

12. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said front molding means includes an L-shaped member extending rearwardly therefrom to define the slot means between the open wire shelf and said L-shaped member.

13. A solid shelf means, in combination with an open wire shelf having a front support member and a rear support member and a plurality of intermediate wire members spatially mounted with respect to one another defining longitudinal openings therebetween, for forming a flat support surface adjacent and in abutment with the open wire shelf as defined in claim 1 wherein said main plate section of said cover plate means defines at least one opening therein to facilitate product retainment and cooling thereof.

14. A solid shelf means, in combination with an open wire shelf having a front support member and a rear support member and a plurality of intermediate wire members spatially mounted with respect to one another defining longitudinal openings therebetween, for forming a flat support surface adjacent the open wire shelf within a refrigerated display case comprising:

a) a front molding means securable with respect to the front support member of the open wire shelf and defining a slot means thereadjacent extending horizontally immediately above the open wire shelf, said front molding means further including:
   (1) a ticket display means for retaining a pricing ticket therein;
   (2) a product stop means extending therefrom to facilitate retainment of articles located upon said solid shelf means, said product stop means extending generally vertically upwardly with respect to the open wire shelf;
b) a cover plate means being flexibly resilient and detachably securable with respect to the open wire shelf to extend generally horizontally thereover in abutment with respect to the intermediate members of the open wire shelf for forming a solid flat support surface thereon by extending horizontally over the longitudinally extending openings defined therein, said cover plate means including:
   (1) a main plate section being flexible resilient and extending generally horizontally adjacent the intermediate wire members of the open wire shelf and extending horizontally over the longitudinally extending openings defined therein;
   (2) a front edge means along one edge of said main plate section and being adapted to extend into said slot means defined in said front molding means to facilitate detachably securement of said main plate section with respect to the open wire shelf;
   (3) a rear edge means along another edge of said main plate section spaced from said front edge means, said cover plate means being flexibly resilient to selectively decrease the distance between said front edge means and said rear edge means thereof to facilitate detachable securement of said cover plate means with respect to the open wire shelf; and
   (4) a rear attachment means located adjacent said rear edge means of said cover plate means to facilitate attachment of said rear edge means with respect to the rear support member and attachment of said main plate section with respect to the open wire shelf, said rear attachment means comprising an L-shaped member adapted to extend under the rear support member of the open wire shelf to facilitate detachable securement of said cover plate means with respect to open wire shelf.

15. A convertible shelf means being selectively usable as an open wire shelf and as a flat support surface shelf comprising:

a) an open wire shelf defining a plurality of openings therethroughout, said open wire shelf including:
   (1) a plurality of intermediate wire members spatially mounted with respect to one another to define a plurality of openings therebetween;
   (2) a rear support member attached with respect to said intermediate wire members to facilitate mounting of said open wire shelf with respect to environmental structure as desired;
   (3) a front support member attached with respect to said intermediate wire members oppositely from said rear support member;
b) a front molding means detachably securable with respect to said front support member of said open wire shelf and defining a slot means therein adjacent said open wire shelf;
c) a cover plate means being flexibly resilient and detachably securable with respect to said open wire shelf to extend generally horizontally thereover in abutment with respect to said intermediate members of said open wire shelf for forming a solid support surface thereon, said cover plate means including:
   (1) a main plate section being flexibly resilient and extending generally horizontally adjacent said intermediate wire members of said open wire shelf;
   (2) a front edge means along one edge of said main plate section and being adapted to extend into said slot means defined in said front molding means to facilitate detachably securement of said main plate section with respect to said open wire shelf;
   (3) a rear edge means along another edge of said main plate section spaced from said front edge means, said rear edge means being flexibly resilient with respect to said front edge means to facilitate detachable securement of said cover plate means with respect to said open wire shelf; and
   (4) a rear attachment means located adjacent said rear edge means of said cover plate means to facilitate attachment of said rear edge means with respect to said rear support member and attachment of said main plate section with respect to said open wire shelf.

16. A convertible shelf means being selectively usable as an open wire shelf and as a flat support surface shelf as defined in claim 15 wherein said intermediate wire members define longitudinally extending openings therebetween.

17. A convertible shelf means being selectively usable as an open wire shelf and as a flat support surface shelf as defined in claim 15 wherein said front molding means includes a ticket display means for detachably retaining a price ticket therein.

18. A convertible shelf means being selectively usable as an open wire shelf and as a flat support surface shelf as defined in claim 15 wherein said cover plate means is of plastic.

19. A convertible shelf means being selectively usable as an open wire shelf and as a flat support surface shelf as defined in claim 15 wherein said cover plate means is of polyvinylchloride.

20. A convertible shelf means being selectively usable as an open wire shelf and as a flat support surface shelf as defined in claim 15 wherein said cover plate means is made of flexible steel.

21. A convertible shelf means being selectively usable as an open wire shelf and as a flat support surface shelf as defined in claim 15 wherein said front molding means is made of plastic.

22. A convertible shelf means being selectively usable as an open wire shelf and as a flat support surface shelf as defined in claim 15 wherein said front molding means is made of metal.

23. A convertible shelf means being selectively usable as an open wire shelf and as a flat support surface shelf as defined in claim 15 wherein said front molding means includes a product stop means extending outwardly therefrom to facilitate retainment of articles located upon said solid shelf means.

24. A convertible shelf means being selectively usable as an open wire shelf and as a flat support surface shelf as defined in claim 23 wherein said product stop means extends vertically upwardly with respect to said main plate section to facilitate retainment of articles located thereupon.

25. A convertible shelf means being selectively usable as an open wire shelf and as a flat support surface shelf as defined in claim 15 wherein said rear attachment means comprises an L-shaped member adapted to extend under said rear support member of said open wire shelf to facilitate detachable securement of said cover plate means with respect to said open wire shelf.

26. A convertible shelf means being selectively usable as an open wire shelf and as a flat support surface shelf as defined in claim 15 wherein said main plate section of said cover plate means is positioned in abutment with respect to the upper surface of said open wire shelf.

27. A convertible shelf means being selectively usable as an open wire shelf and as a flat support surface shelf as defined in claim 15 wherein said front molding means defines said slot means extending horizontally rearwardly therefrom immediately adjacent the upper surface of said open wire shelf.

28. A convertible shelf means being selectively usable as an open wire shelf and as a flat support surface shelf as defined in claim 15 wherein the distance between said slot means defined in said front molding means and said rear support member is less than the distance between said rear edge means and said front edge means of said cover plate means to facilitate securement of said solid shelf means with respect to said open wire shelf by resilient flexing of said cover plate means.

29. A convertible shelf means being selectively usable as an open wire shelf and as a flat support surface shelf comprising:

a) an open wire shelf defining a plurality of openings therethroughout, said open wire shelf including:
   (1) a plurality of intermediate wire members spatially mounted with respect to one another to define a plurality of openings therebetween;
   (2) a rear support member attached with respect to said intermediate wire members to facilitate mounting of said open wire shelf with respect to environmental structure as desired;
   (3) a front support member attached with respect to said intermediate wire members oppositely from said rear support member;

b) a front molding means detachably securable with respect to said front support member of said open wire shelf and defining a slot means therein adjacent said open wire shelf, said front molding means further defining a ticket display means therein for retaining a price ticket therein as desired, said front molding means further including a product stop means therein extending vertically upwardly therefrom to facilitate retainment of product positioned upon said convertible shelf means;

c) a cover plate means being flexibly resilient and detachably securable with respect to said open wire shelf to extend generally horizontally thereover in abutment with respect to said intermediate members of said open wire shelf for forming a solid support surface thereon, said cover plate means including:
   (1) a main plate section being flexibly resilient and extending generally horizontally adjacent the upper surface of said intermediate wire members of said open wire shelf;
   (2) a front edge means along one edge of said main plate section and being adapted to extend into said slot means defined in said front molding means to facilitate detachably securement of said main plate section with respect to said open wire shelf;
   (3) a rear edge means along another edge of said main plate section spaced from said front edge means, said rear edge means being flexibly resilient with respect to said front edge means to facilitate detachable securement of said cover plate means with respect to said open wire shelf, said rear edge means being located such that the distance between said slot means defined in said front molding means and said rear support member is less than the distance between said rear edge means and said front edge means of said cover plate means to facilitate securement of said solid shelf means with respect to said open wire shelf by resilient flexing of said cover plate means; and
   (4) a rear attachment means located adjacent said rear edge means of said cover plate means to facilitate attachment of said rear edge means with respect to said rear support member and attachment of said main plate section with respect to said open wire shelf, said rear attachment means further comprising an L-shaped member adapted to extend under said rear support member of said open wire shelf to facilitate detachable securement of said cover plate means with respect to said open wire shelf.

* * * * *